United States Patent [19]

Tu Xuan et al.

[11] 4,346,463

[45] Aug. 24, 1982

[54] MOVEMENT DETECTOR FOR A STEPPING MOTOR

[75] Inventors: Mai Tu Xuan, Chavannes; Marcel Jufer, Morges, both of Switzerland; André Pittet, Bangalore, India

[73] Assignee: Societe Suisse pour l'Industrie Horlogere Management Services S.A., Bienne, Switzerland

[21] Appl. No.: 162,227

[22] Filed: Jun. 23, 1980

[30] Foreign Application Priority Data

Jun. 21, 1979 [FR] France ..... 79 16816

[51] Int. Cl.[3] ..... G06F 1/04; H02P 1/40

[52] U.S. Cl. ..... 368/157; 318/696; 368/217

[58] Field of Search ..... 368/76, 80, 85–87, 368/155–157, 159–160, 202, 217–219; 318/696

[56] References Cited

U.S. PATENT DOCUMENTS

| | | | |
|---|---|---|---|
| 4,112,345 | 9/1978 | Goddijn | 318/696 |
| 4,114,364 | 9/1978 | Takahashi | 368/204 |
| 4,208,868 | 6/1980 | Regnier et al. | 368/62 |
| 4,212,156 | 7/1980 | Kawanura et al. | 368/85 |
| 4,241,433 | 12/1980 | Ueda et al. | 368/76 |
| 4,271,496 | 6/1981 | Shida et al. | 368/80 |

FOREIGN PATENT DOCUMENTS

| | | | |
|---|---|---|---|
| 2854084 | 6/1979 | Fed. Rep. of Germany | 368/85 |
| 2220919 | 10/1974 | France | 368/80 |
| 2384289 | 10/1978 | France | 368/80 |
| 2388323 | 11/1978 | France | 368/85 |

*Primary Examiner*—Vit W. Miska

*Attorney, Agent, or Firm*—Griffin, Branigan & Butler

[57] ABSTRACT

A feed arrangement enabling detection of the movement of a stepping motor and providing such motor with a series of long duration pulses in the event of failure to step responsive to a short duration pulse. The detector comprises means for sampling a first signal developed by the current in the motor winding and generating a second signal which is the integral of the first, in order to detect whether or not the motor has stepped. The invention is intended for use with micromotors as found in timepieces.

4 Claims, 9 Drawing Figures

Fig.1.
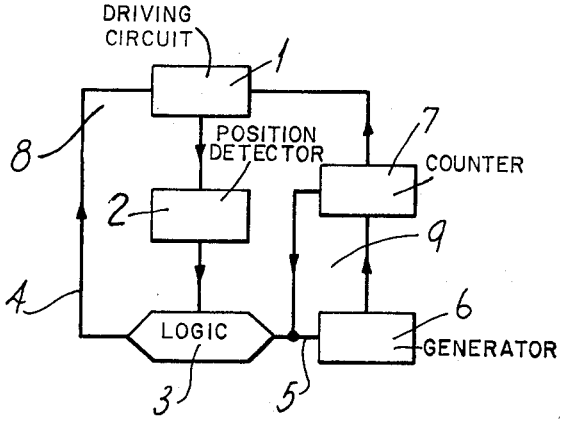
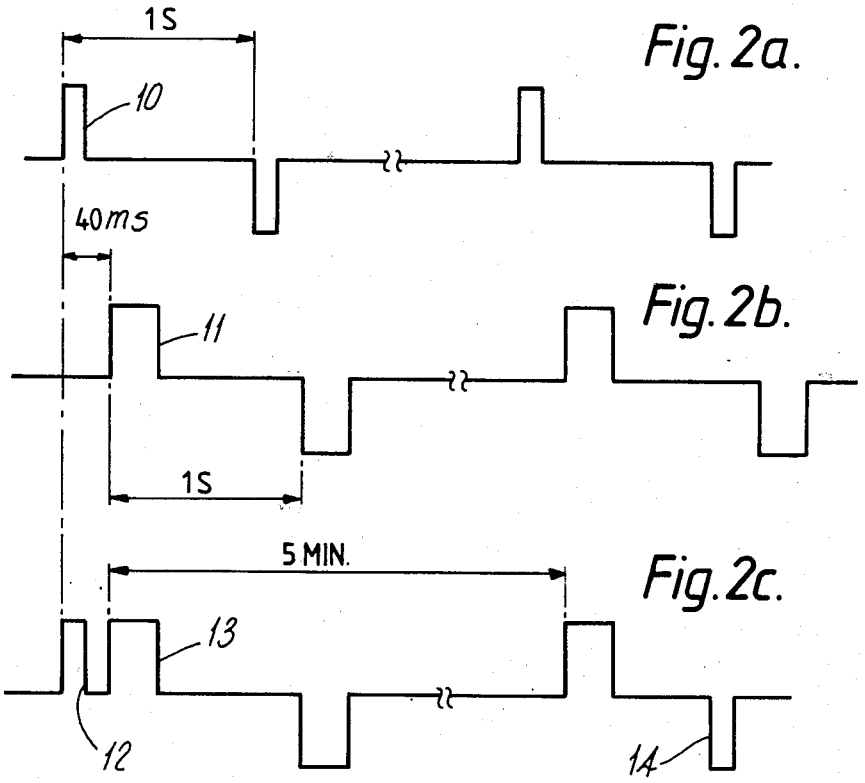

MOVEMENT DETECTOR FOR A STEPPING MOTOR

BACKGROUND OF THE INVENTION

The objective of the present invention is to provide a feeding arrangement enabling detection of the movement of a single phase stepping motor, as used for instance in a timepiece, and arranged to control the operation of the motor by supplying a first type of bipolar pulses of short duration or by supplying a second type of bipolar pulses of greater duration, pulse train of the second type being fed to the motor in the event that the motor has failed to step in response to a short duration pulse.

Arrangements of this type are already known. The German laid open specification DEOS 27 45 052 describes a control system which supplies the motor with a low energy signal if the motor load is low and a greater energy signal if the motor load is heavy and does so with the purpose of diminishing by approximately 60% the energy consumption of the timepiece. The device operates by transforming from the first type of signal to the second type of signal on determining the motor current curve form the peak of which is displaced towards the right when the motor load increases. Through detecting the position of the maxima it thus becomes possible to send to the motor a wide pulse, for instance 7.8 ms, whenever the mechanical moment increases, this being the case for example whenever the calendar date should be changed. Such a system is however incapable of detecting, following such wide pulse, whether or not the motor has advanced through a step. There may thus be circumstances here a series of pulses of greater width has been sent to the motor unnecessarily.

Another arrangement is described in French patent applications FR 2,384,289, FR 2,388,323 wherein the detecting of the motor step being foreseen. In these patent applications the motor arrangement is such as to provide a saturable zone. In these circumstances a detection pulse having on the order of one ms width enables detection of whether or not the rotor has turned. If the step has not been made a correction pulse (for instance 7.8 ms) is immediately sent to the motor and replaces the normal advancing pulse (3.9 ms). As already mentioned such a system requires a motor having a saturable zone and thus presents the difficulty of not always being applicable to every motor used within the industry. On the other hand it may be noted that the detection voltage is doubled whenever the motor makes its step. The present invention proposes a voltage difference much greater and this provides a greater security of operation as will be explained hereinafter.

Again there may be cited the Swiss published application CH 13 723/72 which proposes differentiation of the detection signal and prolongation of the advance pulse as a function of the mechanical load applied to the motor. This system presents the difficulty that the detection of the greatest rotor speed does not necessarily signify that the said rotor has stepped as will appear from the following explanations.

Finally U.S. Pat. No. 4,114,364 also proposes to prolong the advance pulse in response to the motor load. Aside from the fact that this system does not detect rotation of the rotor it further presents the difficulty of an increased energy consumption which is contrary to the present object.

SUMMARY OF THE INVENTION

It is the purpose of this invention to overcome the previously mentioned difficulties and to obtain a control arrangement which will economise energy from the source and at the same time be reliable in its operation.

The feed arrangement according to the invention is characterized by the fact that it comprises a step detector comprising first means for sampling a first signal Ud developed by the current which traverses the winding of the motor and second means for creating a second signal $$Uc = \int_{O}^{T} Ud\,dt$$

the value of which indicates whether or not the motor has stepped, responsive to a small width pulse.

BRIEF DESCRIPTION OF THE DRAWINGS

FIG. 1 is the organisational block of a feed arrangement for control of the motor steps.

FIG. 2 represents the various signals applied to the motor.

DETAILED DESCRIPTION OF THE INVENTION

Figure 3:
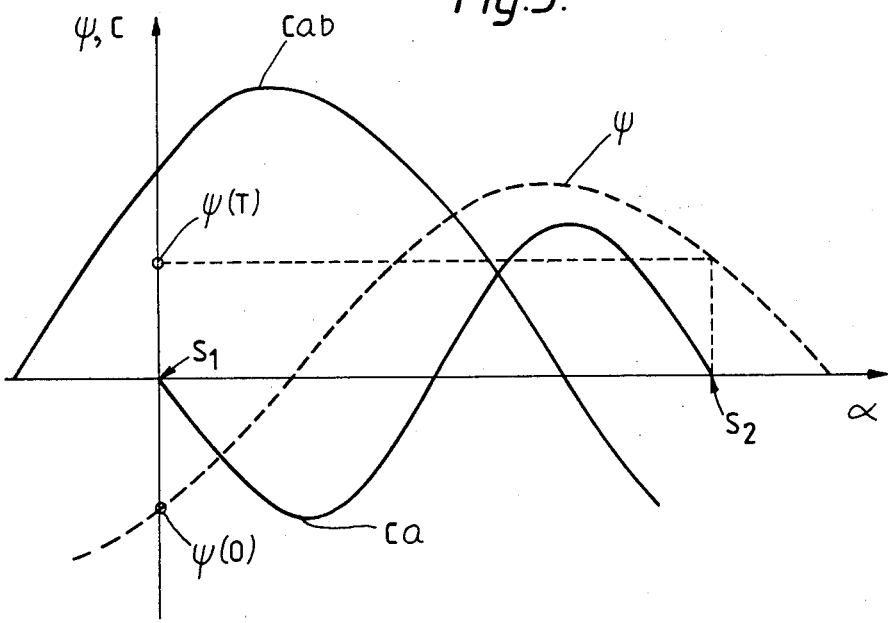
FIG. 3 shows the form of the mutual couple, positioning couple and the mutual flux magnet-to-winding as a function of the position of the rotor.

The invention now to be described has as a prime object, the reduction of current consumption by a timepiece motor. It has been determined that a micromotor for a watch works for the most part almost with no load. At the same time to assure a satisfactory functioning under special conditions, as for instance, temperature variations, exterior magnetic fields, shocks, angular accelerations, etc, it is found necessary to overfeed the motor, this leading to purposeless consumption of battery energy. The present invention provides a new arrangement for controlling the stepping of the motor which enables the adaptation with good safety margins of the feeding as a function of the load from whence there results a substantial improvement in the energy consumption.

The general principal of motor feeding such as has been already mentioned in certain patents mentioned above is shown in FIG. 1 which is an organisational block of the feeding with control of the motor steps. A driving circuit 1 includes a motor and a pulse generator. The motor is normally fed by short duration pulses (f. ex. 6 ms) emitted by the pulse generator. A position detector 2, object of the present invention, and which will be described in greater detail further on enables one to determine whether or not the motor has stepped. In the affirmative the logic 3 informs generator 1 via line 4 that it must continue to feed the motor. In the negative the same logic controls generator 6 via line 5 so as to provide long duration pulses (f. ex. 8 ms) which feed the motor and which are substituted for the short duration pulses. This substitution takes place during a period of n seconds determined by counter 7. Following this lapse of time, the motor is once again fed by short duration pulses. It is seen that the motor is alternately fed and in accordance with its needs either by loop 8 giving short duration pulses, the detector being in operation, or by loop 9 giving pulses of long duration during a period determined by the counter, the detector being out of the circuit. The different anomalous situations which may arise during operation owing to causes such as previously mentioned last for a certain time. It will thus be understood that to send systematically a long pulse following each short pulse which had not stepped the motor would be wasteful of energy and contrary to the purpose at which the invention aims. The period during which long duration pulses are sent to the motor is on the order of five minutes but other values might equally be chosen.

FIG. 2*a* represents the train of short duration pulses which is sent to the motor to effect stepping threreof. Pulses 10 which are bipolar and of a duration of about 6 ms are emitted each second by driving circuit 1. FIG. 2*b* represents the train of long duration pulses 11 of a duration on the order of 8 ms emitted by generator 6, these pulses also succeeding one another at the rhythm of one each second. For reasons which will be set forth later the beginning of the long pulse is staggered 40 ms relative to the beginning of the short duration pulse and when, following pulse 12 shown in FIG. 2*c*, the position detector determines the absence of rotation, the series of long pulses 13 is sent to the motor during about 5 minutes, following which the motor is again switched to the short pulses 14.

FIG. 3 represents the value of couples C which act on the rotor as a function of its rotation angle $\alpha$. As is well known, the rotor of the stepping motor is subject to two types of couples: a static retaining couple Ca due to the magnet alone and the dynamic motor couple Cab due to the interaction of the flux of the magnet with the flux of the winding whenever the latter is energised. Initially the rotor is in position $S_1$. If a pulse is sent to the motor and steps the rotor it will be found in position $S_2$. On the same FIG. 3 has been represented the value of the mutual flux, winding-magnet $\Psi$ as a function of the rotation angle of the rotor. The present invention is based on determining the value of this flux which may take different values according to whether the motor has stepped or not.

The differential equation of the voltage measured at the terminals of the micromotor may be written:

$$U = Ri + L\frac{di}{dt} + \frac{d\psi}{dt} \tag{1}$$

in which

U=voltage at the motor terminals,
R=total resistance of the circuit,
L=inductance of the winding,
i=current in the winding,
$\Psi$=mutual flux magnet-winding, By integrating between 0 and T one obtains:

$$\int_0^T (U - Ri)\,dt = L \cdot i(T) + (\psi(T) - \psi(0)) \tag{2}$$

By choosing a time T greater than the pulse duration for instance 30 ms all current will have ceased in the motor winding so that i (T)=0. On the other hand by observing the value which the flux may take as shown in FIG. 3 it will be noted that:

$\Psi(T) = -\Psi(0)$ if the motor has stepped and $\Psi(T) = \Psi(0)$ if the motor has not stepped so closely that the relation 2 becomes:

$$\int_0^T (U - Ri)\,dt = \begin{cases} 2\,\psi(T) & \text{if the motor has made its step and} \\ 0 & \text{if the motor has not made its step.} \end{cases}$$

This demonstration shows that through integrating the voltage measured at the terminals of the motor between the time at which the pulse is established and the time at which the current has substantially ceased to flow in the winding, one obtains two voltage levels greatly different according to whether the motor has stepped or not. The above relations also show that in the system of detection as proposed, the difference of voltage level is independent of the feed voltage and of the internal resistance of the battery.

The principal of the operation of the detector according to the invention will now be explained in detail by means of the diagram of FIG. 4*a*.

Signals coming from the divider circuit 20 are applied to a circuit 21. This latter circuit includes a generator serving to generate short duration pulses 1, the long duration impulse generator 6 and the counter 7 such as have been explained in respect of FIG. 1. The output voltage Um has either the configuration shown in FIG. 2*a* or that shown in FIG. 2*c* according to whether or not the motor has stepped. Um is coupled to the diagonal a-b of a bridge of which one branch is occupied by the motor winding 22. The voltage Ud which is developed over the other diagonal c-d of the bridge is applied to the input of differential amplifier 23 having a gain g. It is apparent from the figure that:

$$\frac{R_2}{R_1 + R_2} = \frac{Rsh}{Rm + Rsh}$$

$$\text{and that } U_1 = Um\frac{R_2}{R_1 + R_2}$$

and that $U_2 = Rsh \cdot i$. As $Ud = U_1 - U_2$, it follows that $$Ud = Um \cdot \frac{R_2}{R_1 + R_2} - Rsh \cdot i = Rsh\left(\frac{Um}{Rm + Rsh} - i\right)$$

In turn the output voltage g·Ud of the amplifier is applied to an integrator 24 with which is associated a resistance R and a capacitor C. The output voltage Uc from the integrator is written:

$$Uc = \frac{g}{RC}\int_0^T Rsh\left(\frac{Um}{Rm + Rsh} - i\right)dt$$

-continued $$= \frac{g}{RC} \cdot \frac{Rsh}{Rm + Rsh} \int_0^T [Um - (Rm = Rsh)\, i]\, dt$$

Which in view of equation (2) is finally written:

$$Uc = \frac{g}{RC} \cdot \frac{Rsh}{Rm + Rsh} (\psi(T) - \psi(0)) \quad (3)$$

The signal Uc is compared to a reference voltage Ur in a comparator 25. This comparison takes place about 30 ms after the beginning of the advancing pulse, thanks to a clock signal coming from the frequency divider. If Uc is greater than Ur, the motor has made its step and no signal will appear at the output of the comparator: the circuit 21 continues to emit short duration pulses. If on the contrary Uc is smaller than Ur, the motor has failed to step and there will appear a signal Us at the output of the comparator which via line 26 causes the circuit 21 to emit a series of long duration pulses 13 as shown in FIG. 2*c*. During the time that impulses 13 are emitted the amplifier 23 is blocked by line 27.

Figure 4B:
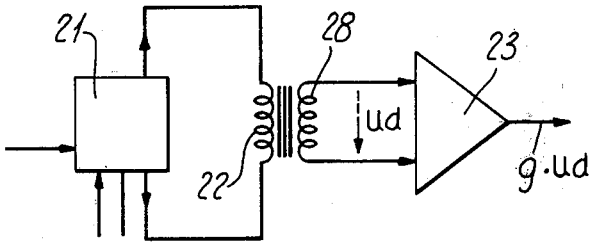
FIG. 4*b* shows a variant of the principal.
Figure 4A:
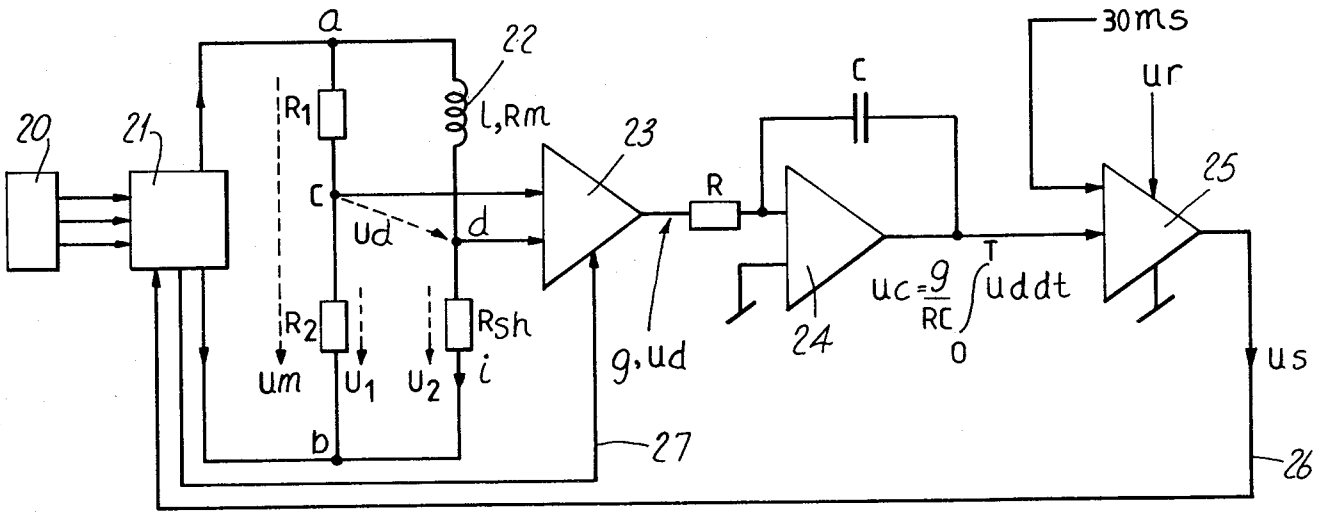
FIG. 4*a* shows the block diagram of the principal of detection in accordance with the invention.

FIG. 4*b* shows a variant of the invention. To the motor winding 22 is magnetically coupled detecting winding 28, at the terminals of which will be developed a voltage Ud which is applied to a circuit similar to that which has previously been described.

If one now examines equation 3 it will be seen that the parameters which influence the voltage Uc may be classified into two categories: those which depend on the electronics (g, R, C, Rsh, $R_1$ and $R_2$) and the single parameter which depends on the motor and which is the difference in the level of the mutual flux at the instant t=0 and at the instant t=T. This last parameter is conditioned on the coupling factor of the motor, by the phase shift between the couples Cab and Ca and by the relationship existing between the couple representing dry friction and the couple Ca. Measurements made on models have shown that, taking into account various circumstances which may arise, the relationship between the minimum voltage Uc as produced by a successful step and the maximum voltage Uc which exists if the rotor has not stepped is greater than 12. There thus results that the proposed system is very reliable since the detection of the step is practically independent of the dispersion of the motor parameters. It follows that the reference voltage Ur may be chosen within rather large limits thus simplifying realisation of the comparator 25.

The short pulse has a duration of about 6 ms and the long pulse a duration of around 8 ms. As explained above, measuring of the voltage Uc by the comparator takes place 30 milliseconds following the beginning of the advancing pulse. This value may vary according to the type of motor utilized and lower values may be chosen provided that at this moment all current has substantially ceased in the winding. There will now be understood the reason for the time displacement between the beginning of the short pulse and the beginning of the train of long pulses as shown on FIG. 2*c*. This time displacement depends naturally from the moment which has been chosen for the measuring of voltage Uc since the series of long pulses will only be applied if necessary following such measuring. The figure shows a time displacement of 40 ms for measurements made following 30 ms. If this measuring should occur earlier, for instance after 15 ms, the time displacement could be shortened to 25 ms.

Figure 5:
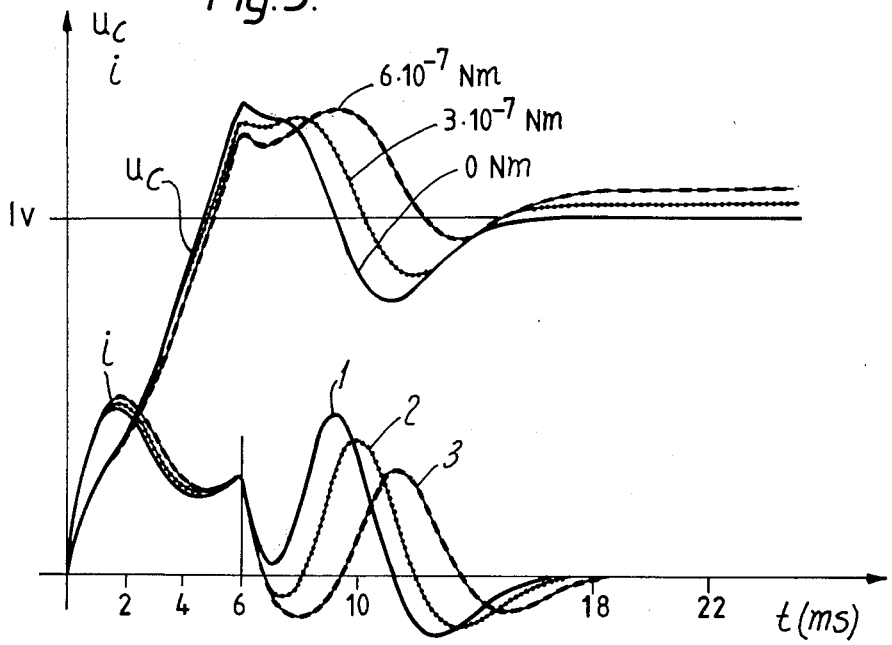
FIG. 5 shows the form of the output voltage at the integrator and of the current in the winding when the motor has made a step.

FIG. 5 shows voltage Uc and current i forms the winding when the motor has stepped responsive to a short duration pulse of 6 ms and for a well knows type of stepping motor. Curve 1 has been obtained for a zero couple applied to the motor shaft, curve 2 for a couple of $3 \cdot 10^{-7}$ Nm and curve 3 for a couple of $6 \cdot 10^{-7}$ Nm. It will be noted that if measurements take place after a time t>18 ms the voltage Uc measured at the output of the integrator has a value of the order of 1 volt. To be noted here is the displacement toward the right of the maximum of the current when the couple increases (see publication of the DEOS 27 45 052) but which is not here a criterion of successful stepping.

Figure 6:
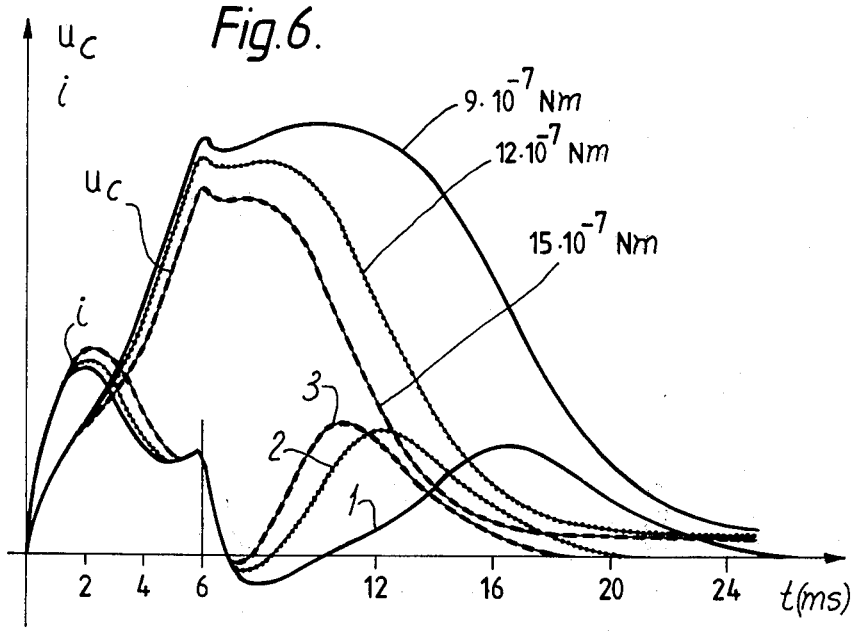
FIG. 6 shows the form of the voltage at the output of the integrator and the current in the winding when the rotor has failed to step.

FIG. 6 shows the form of the voltage Uc and of the current i in the winding when the rotor has not stepped in response to a short duration pulse of 6 ms. Curve 1 has been obtained for a couple of $9 \cdot 10^{-7}$ Nm applied to the motor shaft, curve 2 for a couple of $12 \cdot 10^{-7}$ Nm and curve 3 for a couple of $15 \cdot 10^{-7}$ Nm. It will be seen immediately that following a time t>24 ms the voltage Uc at the output of the integrator is very low. It is to be noted here that detecting the maximum speed, or should one prefer, minimum current between 0 and 6 ms as proposed in the cited application CH 13 723/72, might lead to the conclusion that a step has been made when such is not the case, as shown by the diagram.

As mentioned previously the system has for principal purpose to limit the consumption of energy in a timepiece and to do so by means of an integrator which may suit any stepping motor. With a motor dimensioned such as herein proposed an economy of energy on the order of 60% has been measured.

What we claim is:

1. A feed arrangement for a single phase timepiece stepping motor arranged to control the functioning of the motor by means of a first type of bipolar pulses of relatively small width or by a second type of bipolar pulses of greater width, a series of pulses of the second type being applied to the motor whenever said motor has failed to step in response to pulses of the first type wherein there is provided a step detector including first means arranged to sample a first signal Ud developed by the current through the motor winding and second means arranged and adapted to generate a second signal $$Uc = \int_O^T Ud\, dt$$

the level of which indicates whether or not the motor has stepped in response to a pulse of the first type.

2. A feed arrangement as set forth in claim 1 wherein the first means comprises a bridge, one branch of which is formed by the motor winding, the first diagonal thereof being fed by said first or second types of pulses and the second diagonal providing the input signal Ud to a differential amplifier, the output of which is coupled to the input of said second means which comprises an integrator, the output signal Uc of the integrator being sent to a comparator thereby to compare the integrated signal Uc to a reference signal Ur in order to provide a detection signal Us whenever the motor fails to step in response to a pulse of the first type.

3. A feed arrangement as set forth in claim 1 wherein the first means includes a detection winding in the magnetic circuit of the motor, the potential developed at the terminals of said detection winding constituting the input signal Ud of a differential amplifier, the output of which is coupled to the input of said second means which comprises an integrator, the output signal Uc of the integrator being sent to a comparator thereby to compare the integrated signal Uc to a reference signal Ur in order to provide a detection signal Us whenever the motor fails to step in response to a pulse of the first type.

4. A feed arrangement as set forth in claims 2 or 3 wherein the comparator provides the detection signal Us as soon as the current in the motor winding has substantially ceased to flow.

* * * * *